US011846057B2

(12) United States Patent
Chapman et al.

(10) Patent No.: US 11,846,057 B2
(45) Date of Patent: Dec. 19, 2023

(54) STABILIZER FOR A ROTATABLE DRUM

(71) Applicants: Wade Chapman, Thomasville, GA (US); Nathan Parrow, Oklahoma City, OK (US)

(72) Inventors: Wade Chapman, Thomasville, GA (US); Nathan Parrow, Oklahoma City, OK (US)

(73) Assignee: Wade Chapman, Thomasville, GA (US)

( * ) Notice: Subject to any disclaimer, the term of this patent is extended or adjusted under 35 U.S.C. 154(b) by 0 days.

(21) Appl. No.: 18/186,138

(22) Filed: Mar. 17, 2023

(65) Prior Publication Data

US 2023/0228025 A1 Jul. 20, 2023

Related U.S. Application Data

(63) Continuation-in-part of application No. 17/122,279, filed on Dec. 15, 2020, now Pat. No. 11,608,578.

(60) Provisional application No. 62/949,384, filed on Dec. 17, 2019.

(51) Int. Cl.

| | |
|---|---|
| ***D06F 37/22*** | (2006.01) |
| ***D06F 37/30*** | (2020.01) |
| ***D06F 37/04*** | (2006.01) |

(52) U.S. Cl.

CPC ..... *D06F 37/22* (2013.01); *D06F 37/04* (2013.01); *D06F 37/304* (2013.01)

(58) Field of Classification Search

CPC ..... D06F 37/22; D06F 37/04; D06F 37/304

See application file for complete search history.

(56) References Cited

U.S. PATENT DOCUMENTS

| | | | | |
|---|---|---|---|---|
| 2,643,536 | A | 6/1953 | Neher | |
| 4,232,486 | A | 11/1980 | Rampe | |
| 9,637,854 | B2 | 5/2017 | Jung et al. | |
| 2016/0258097 | A1* | 9/2016 | Hake | D06F 23/06 |
| 2016/0258101 | A1* | 9/2016 | Hake | D06F 29/02 |
| 2020/0010997 | A1* | 1/2020 | Kwon | D06F 37/04 |
| 2023/0183908 | A1* | 6/2023 | Sriram | D06F 58/04 68/13 R |
| 2023/0228025 | A1* | 7/2023 | Chapman | D06F 37/304 68/12.01 |

FOREIGN PATENT DOCUMENTS

| | | |
|---|---|---|
| CN | 202440673 U | 9/2012 |

OTHER PUBLICATIONS

Appliancepartspros.com, How to: Whirlpool/KitchenAid/Maytag Drum Support Roller 12001541, viewed at: https://www.youtube.com/watch?v=VTH4yJCoM0g on Feb. 3, 2020.

* cited by examiner

*Primary Examiner* — David Phantana-angkool

(74) *Attorney, Agent, or Firm* — Law Office of Steven R. Olsen, PLLC; Steven R. Olsen

(57) ABSTRACT

The invention is directed to a rotatable drum for a washing machine or similar equipment. Embodiments of the invention include an outer drum, a rotatable inner drum, and a stabilization assembly coupled to the outer drum and the rotatable inner drum.

7 Claims, 5 Drawing Sheets

STABILIZER FOR A ROTATABLE DRUM

CROSS-REFERENCE TO RELATED APPLICATIONS

This application is a continuation-in-part (CIP) of prior U.S. application Ser. No. 17/122,279, filed Dec. 15, 2020, which claims the benefit of U.S. Provisional Application No. 62/949,384, filed Dec. 17, 2019.

BACKGROUND

Field of Invention

The invention relates generally to mechanical stabilization components for a rotatable drum. More specifically, but not by way of limitation, embodiments of the invention provide improved stabilization features for rotatable drums used in clothes laundering and similar applications.

Description of the Related Art

Clothes laundering is typically performed using hollow cylindrical containers (hereinafter, drums, tubs, or receptacles). For example, a washing machine may include a rotatable drum to contain clothing (and/or other textiles) and fluids during wash, rinse, and spin-dry cycles. Various types of industrial machines use rotatable drums in a similar way for dyeing, coating, mixing, drying, or performing other processes.

Unfortunately, clothing or other drum content may be unevenly distributed when loaded into the drum. Loads may also shift during processing. Such uneven and/or shifting loads can produce unstable drum rotation, leading to failure of drive shafts or other mechanical components. One known method for managing this risk is to operate rotatable drums at relatively low rotational speeds. But operating at relatively low rotational speed may be disadvantageous for some applications. For instance, a drum operating at a relatively high rotational speed may be more effective than a drum operating at relatively low rotational speed for removing water from clothing during a spin-dry cycle in a clothes washing machine. Improved drum features that enable a rotatable drum to operate at relatively high rotational speed is needed for a variety of applications.

SUMMARY OF THE INVENTION

The invention seeks to overcome one or more limitations of prior art rotatable drums in washing machines and similar equipment. Embodiments of the invention include an outer drum, a rotatable inner drum, and a stabilization assembly coupled to the outer drum and the rotatable inner drum.

DESCRIPTION OF THE DRAWINGS

Embodiments of the invention are illustrated in the drawings, wherein.

DETAILED DESCRIPTION

Figure 1:
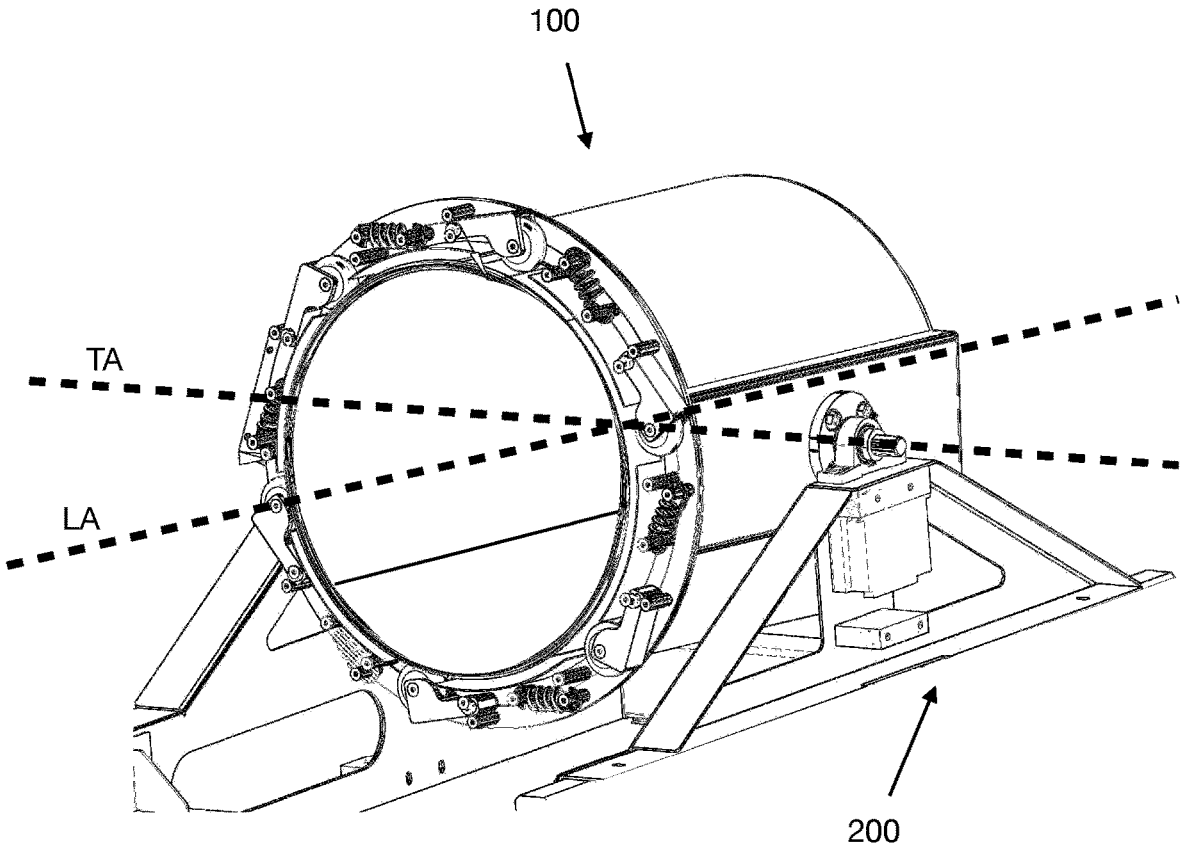
FIG. 1 is a perspective view of a washer drum and carrier.

This section describes embodiments of the invention with reference to FIGS. 1-5. Such embodiments are meant to be illustrative and not restrictive. In the drawings, reference designators are reused for the same or similar features. Some features may be simplified, omitted, or not specifically referenced for descriptive clarity. Although sub-headings are used below for organizational convenience, disclosure of any particular feature is not necessarily limited to any section.

System Overview

Figure 2:
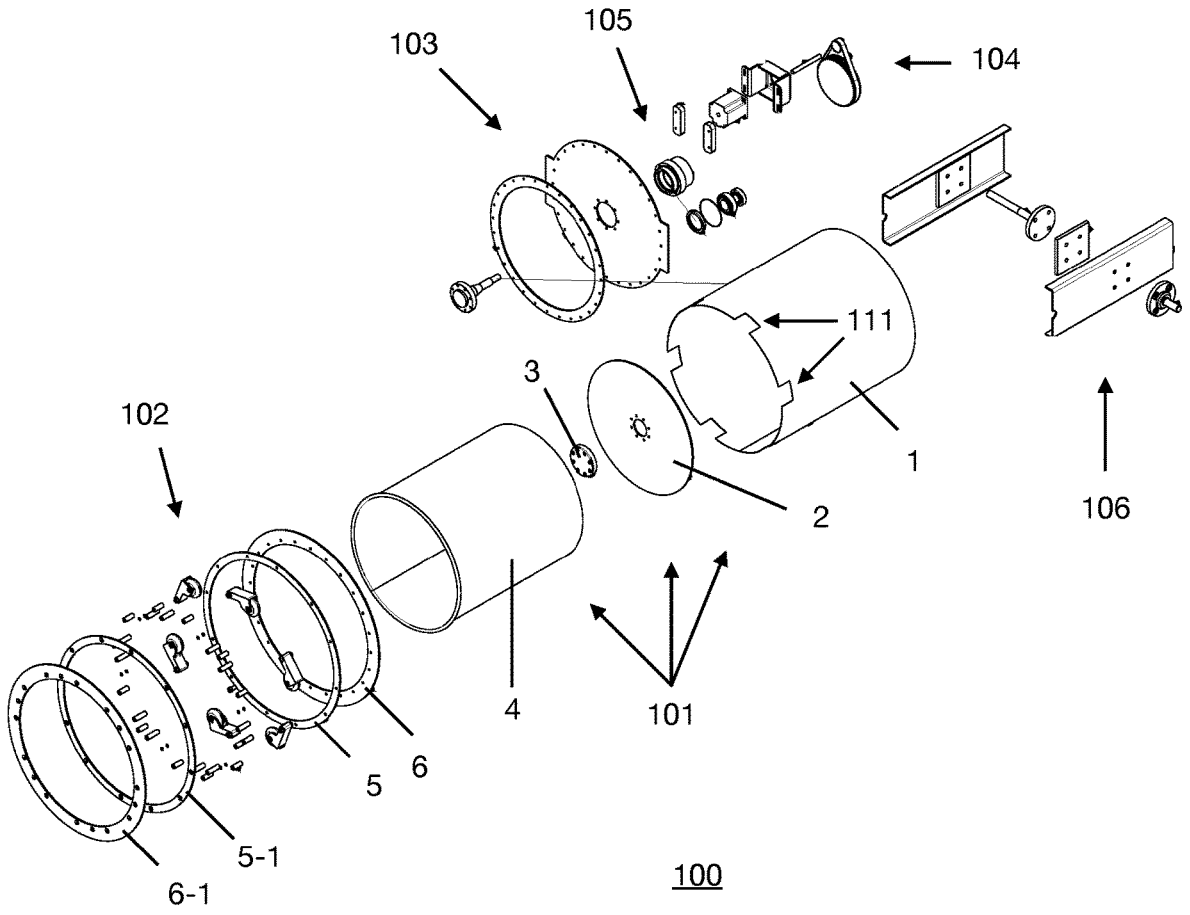
FIG. 2 is an exploded view of the washer drum.
Figure 3:
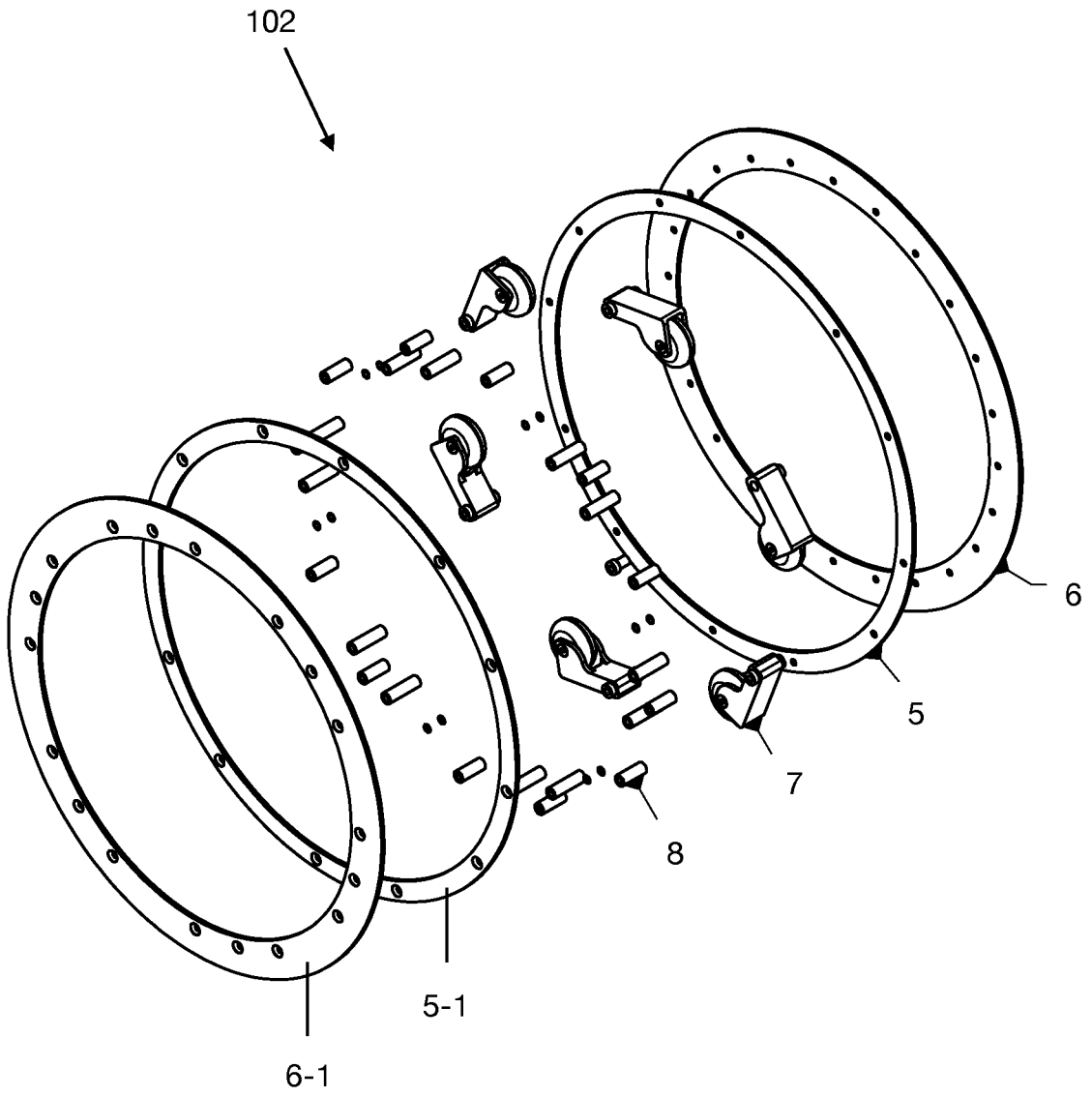
FIG. 3 is an exploded view of a stabilizer assembly.

FIG. 1 is a perspective view of a washer drum 100 and carrier 200. Floating ring 5-1 and fixed ring 6-1, which are part of the washer drum 100, and which are illustrated in FIGS. 2 and 3, are excluded from FIG. 1 to reveal other features. The carrier 200 is a supporting structure for the washer drum 100. The carrier 200 enables the washer drum 100 to rotate (tilt) about a tilt axis TA. An inner drum 4 (illustrated in FIGS. 2, 4, and 5 below) is a component of the washer drum 100, and is also configured to rotate (and preferably spin) about a linear axis LA (i.e., cylindrical or longitudinal axis).

A supporting structure for the washer drum 100 that is substantially different from the illustrated carrier 200 could be used according to application needs. For instance, in some embodiments, it may not be necessary to rotate the washer drum 100 about the tilt axis TA.

Assemblies

FIG. 2 is an exploded view of the washer drum 100. As shown, the washer drum 100 includes: a drum assembly 101, a stabilizer assembly 102, a drum bottom assembly 103, a drum motor assembly 104, a hub assembly 105, and a drum bracket assembly 106. The drum bracket assembly 106 is mounted to an exterior surface of the outer drum 1, and facilitates coupling of the washer drum 100 to the carrier 200.

In the illustrated embodiment, the drum assembly 101 includes an outer drum 1, an end plate 2, a hub top 3, and an inner drum 4. The outer drum 1 includes cutouts 111 in its body at a top (open) end. The drum bottom assembly 103 is coupled to a bottom (closed) end of the outer drum 1. The end plate 2 and hub top 3 are connected to each other, and fixed to a bottom (closed) end of the inner drum 4. The inner drum 4 is nested within the outer drum 1 and is configured to rotate (and preferably spin) about the linear axis LA shown in FIG. 1. Clothing, water, detergent, or other items may be disposed directly in the inner drum 4 during use. In alternative embodiments, a removable cartridge bin (not shown) could be disposed in, and coupled to, the inner drum 4 to contain clothing or other items during processing.

In operation, the drum motor assembly 104 cooperates with the hub assembly 105, the drum bottom assembly 103, the end plate 2, and the hub top 3 to rotate the inner drum 4 at a predetermined time, direction and speed within the outer drum 1. For instance, in some embodiments, the movement of inner drum 4 may be alternated between a clockwise and a counterclockwise rotational direction about the linear axis LA, at relatively low speed, to produce agitation during a wash cycle. The inner drum 4 can also be rotated in a single direction about the linear axis LA at relatively high speed, for example during a spin dry cycle.

Figure 4:
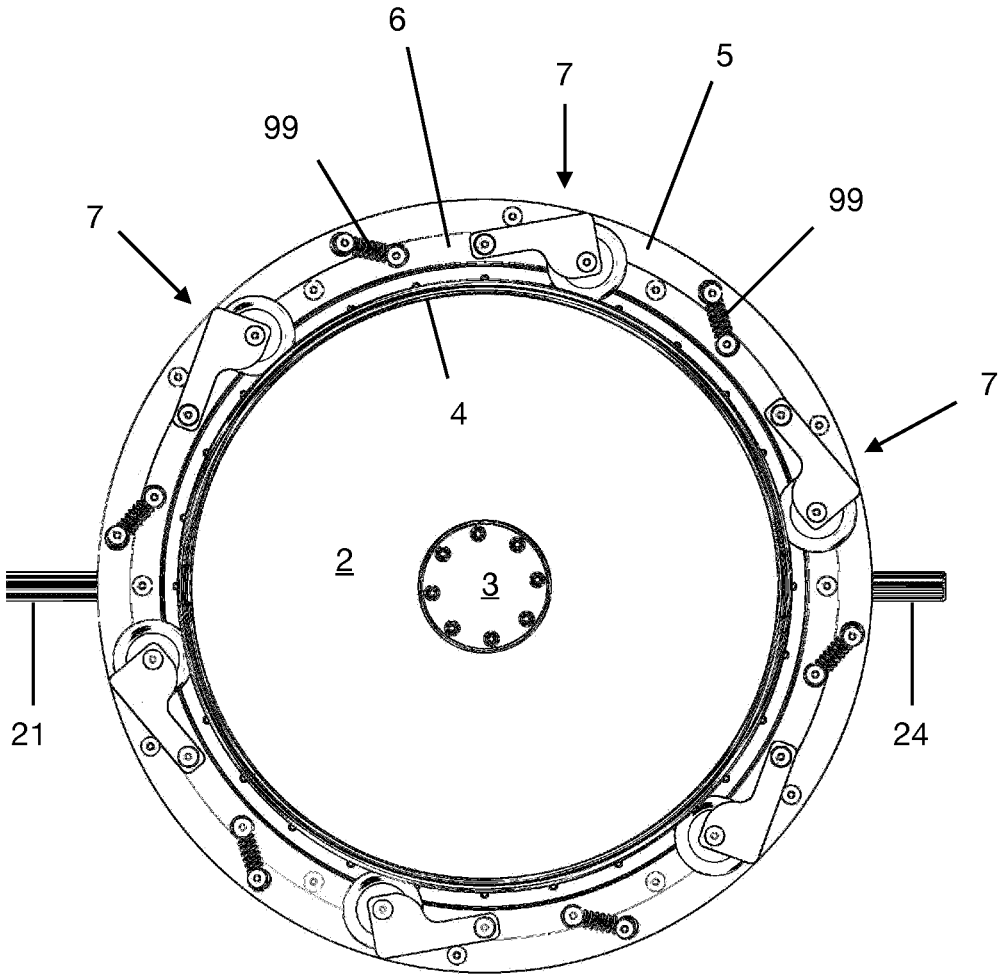
FIG. 4 is a front elevation view of the washer drum.
Figure 5:
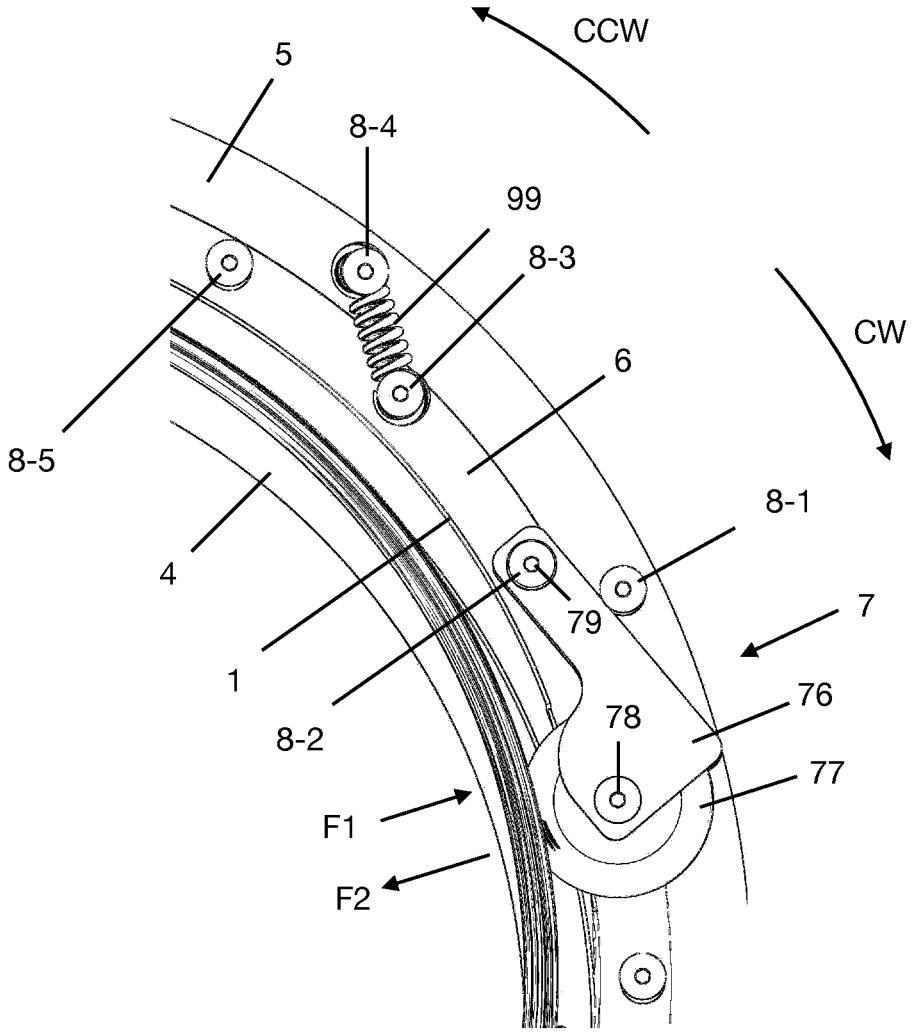
FIG. 5 is a front elevation detail for a portion of the washer drum.

The stabilizer assembly 102 is also illustrated in FIGS. 3-5, where: FIG. 3 is an exploded view of the stabilizer assembly 102 (with tension springs 99 removed for clarity); FIG. 4 is a front elevation view of the washer drum 100 (with floating ring 5-1 and fixed ring 6-1 removed for clarity); and FIG. 5 is a front elevation detail for a portion of the washer drum 100 that is illustrated in FIG. 4.

As shown in FIG. 3, the stabilizer assembly 102 includes floating rings 5 and 5-1, fixed rings 6 and 6-1, multiple rollers 7, and multiple spacers 8. As assembled, rollers 7 and a first set of the spacers 8 are coupled between the fixed rings 6 and 6-1. The floating rings 5 and 5-1 are disposed inside of the fixed rings 6 and 6-1, respectively. Floating ring 5 is connected to floating ring 5-1 by a second set of the spacers 8.

FIG. 4 illustrates multiple tension springs 99 coupled between the floating ring 5 and fixed ring 6. In the washer drum 100, fixed rings 6, 6-1, are rigidly fixed to an outer surface of the outer drum 1 near a top end. Floating rings 5, 5-1, are configured to float. As assembled, floating rings 5, 5-1, rotate (together) with respect fixed rings 6, 6-1, and are subject to mechanical forces supplies by tension springs 99 and rollers 7.

Stabilizer Detail and Operation

As shown in FIG. 5, each of the rollers 7 includes a roller body 76 having a pivot mount 79, and a roller wheel 77 coupled to the roller body 76 via an axle 78. Each of the rollers 7 cooperates with a corresponding cutout 111 (best seen in FIG. 2) in the outer drum 1 so each roller wheel 77 can contact an outer surface of the inner drum 4.

With further reference to FIG. 5, spacers 8-2, 8-3, and 8-5 are part of the first set of spacers that couple fixed ring 6 to fixed ring 6-1 (not shown in FIG. 5). Spacers 8-1 and 8-4 are part of the second set of spacers that couple the floating ring 5 to the floating ring 5-1 (not shown in FIG. 5). Spacer 8-1 is also an interference pin with respect to the roller body 76, as further described below. In the illustrated detail, tension spring 99 is connected between spacers 8-3 and 8-4.

In operation, an axial position of inner drum 4 may shift with respect to outer drum 1. Such a shift in axial position imparts a force F1 that rotates roller 7 in a counterclockwise (CCW) direction about pivot mount 79. CCW rotation presses roller body 76 on interference pin 8-1, causes floating rings 5 and 5-1 to also rotate in a CCW direction, and causes tension spring 99 to extend.

As the shifting force F1 is removed, stored energy in tension spring 99 causes it to compress (toward its original shape). This motivates a clockwise (CW) rotation in the floating rings 5 and 5-1, causes interference pin 8-1 to act on the roller body 76, rotates the roller 7 in a CW direction about pivot mount 79, and causes the roller wheel 77 to apply a force F2 on the inner drum 4.

Because stabilizer assembly 102 includes multiple rollers 7 disposed at regular intervals around the circumference of the inner drum 4 (as illustrated in FIG. 4), a uniform stabilization force is advantageously applied to the inner drum 4.

SUMMARY

Embodiments of the invention thus provide a washer drum 100 or other rotatable drum that is configured with a stabilizer assembly 102 to enable relatively high speed operation. Those skilled in the art can readily recognize that numerous variations and substitutions may be made in the invention, its use and its configuration to achieve substantially the same results as achieved by the embodiments described herein. For instance, in alternative embodiments, the outer drum 1 could be replaced by a collar, frame, or other equivalent supporting structure for the stabilizer assembly 102 and rotatable inner drum 4. Inner drum 4 could include a perforated side wall or other drainage features. Inner drum 4 may also include one or more internal baffles or blades to facilitate movement of articles contained therein, based on application requirements. A different number of rollers 7 and tension springs 99 could be used in the stabilizer assembly, according to design choice. Although the stabilizer assembly 102 is described above as having a pair of floating rings and a pair of fixed rings, and alternative embodiment may instead use a single floating ring and/or a single fixed ring. Moreover, features disclosed in this specification could be combined in ways not expressly illustrated or discussed. Accordingly, there is no intention to limit the invention to the illustrated exemplary forms and applications. Many variations, modifications and alternative constructions fall within the scope and spirit of the disclosed invention.

We claim:

1. A system comprising:

an outer drum;

an inner rotatable drum, the inner rotatable drum being disposed within the outer drum; and a stabilizer assembly, the stabilizer assembly including:

a first fixed ring connected to the outer drum, the first fixed ring having a roller assembly coupled to the first fixed ring via a pivot mount, the roller assembly having a roller wheel in communication with the inner rotatable drum;

a first floating ring, the first floating ring having an interference pin, the interference pin configured to interfere with the roller assembly; and a tension spring coupled between the first fixed ring and the first floating ring, the system thus configured to stabilize rotation of the inner rotatable drum within the outer drum about a cylindrical axis.

2. The system of claim 1, wherein the inner rotatable drum includes a perforated side wall to facilitate drainage.

3. The system of claim 1, wherein the inner rotatable drum includes an internal baffle to facilitate movement of articles contained in the inner rotatable drum.

4. The system of claim 1, the stabilizer assembly further comprising a second fixed ring, the second fixed ring coupled to the first fixed ring via a plurality of spacers.

5. The system of claim 1, the stabilizer assembly further comprising a second floating ring, the second floating ring coupled to the first floating ring via a plurality of spacers.

6. The system of claim 1, the stabilizer assembly further comprising:

a second fixed ring, the second fixed ring coupled to the first fixed ring via a first plurality of spacers; and a second floating ring, the second floating ring coupled to the first floating ring via a second plurality of spacers.

7. The system of claim 1 further comprising:

a motor assembly;

a hub assembly coupled to the motor assembly; and an end plate on the rotatable inner drum, the hub assembly being coupled to the end plate to facilitate rotation of the inner rotatable drum about the cylindrical axis.

* * * * *